US007163786B1

(12) United States Patent
Sakizadeh et al.

(10) Patent No.: US 7,163,786 B1
(45) **Date of Patent: *Jan. 16, 2007**

(54) THERMOGRAPHIC MATERIALS CONTAINING IONIC LIQUIDS

(75) Inventors: Kumars Sakizadeh, Woodbury, MN (US); Leif P. Olson, Rochester, NY (US); Peter J. Cowdery-Corvan, Webster, NY (US); Takuzo Ishida, Woodbury, MN (US); David R. Whitcomb, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/234,691

(22) Filed: Sep. 23, 2005

(51) Int. Cl.
*G03C 1/00* (2006.01)

(52) U.S. Cl. ..... 430/617; 430/618; 430/619; 430/620

(58) Field of Classification Search ..... 430/617–620
See application file for complete search history.

(56) References Cited

U.S. PATENT DOCUMENTS

| | | | |
|---|---|---|---|
| 6,531,270 | B1 | 3/2003 | Olson et al. |
| 6,531,273 | B1 | 3/2003 | Olson et al. |
| 6,586,166 | B1 | 7/2003 | Olson et al. |
| 2002/0018970 | A1 | 2/2002 | Hirabayashi |

FOREIGN PATENT DOCUMENTS

| | | | |
|---|---|---|---|
| EP | 1 315 032 | A1 | 5/2003 |

OTHER PUBLICATIONS

U.S. Appl. No. 11/234,711 (D-88581) filed on even date herewith, titled "Thermally Developable Materials Processable At Lower Temperatures" by Maskasky and Scaccia.

*Primary Examiner*—Geraldine Letscher
(74) *Attorney, Agent, or Firm*—J. Lanny Tucker; Louis M. Leichter

(57) ABSTRACT

Ionic liquids are added to black-and-white direct thermographic materials to provide increased image density or to allow for reduced silver coverage (that is, improved silver efficiency). Useful ionic liquids include imidazolium, pyrazolium, pyridinium, pyrimidinium, pyrazinium, tetra-alkylammonium, or tetra-alkylphosphonium cations.

20 Claims, No Drawings

THERMOGRAPHIC MATERIALS CONTAINING IONIC LIQUIDS

FIELD OF THE INVENTION

This invention relates to non-photosensitive black-and-white direct thermographic materials containing ionic liquids. The invention also relates to methods of imaging such direct thermographic materials.

BACKGROUND OF THE INVENTION

Silver-containing direct thermographic imaging materials are non-photosensitive materials that are used in a recording process wherein images are generated by the direct application of thermal energy and in the absence of a processing solvent. These materials have been known in the art for many years and generally comprise a support having disposed thereon one or more imaging layers comprising (a) a relatively or completely non-photosensitive source of reducible silver ions, (b) a reducing agent composition (acting as a black-and-white silver developer) for the reducible silver ions, and (c) a suitable hydrophilic or hydrophobic binder. Thermographic materials are sometimes called "direct thermal" materials in the art because they are directly imaged by a source of thermal energy without any transfer of the image, or image-forming reactants to another material (such as in thermal dye transfer).

In a typical thermographic construction, the image-forming thermographic layers comprise silver salts of long chain fatty acids. The preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver(I) of the silver carboxylate is reduced by a black-and-white reducing agent (also known as a developer) whereby a black-and-white image of elemental silver is formed.

Problem to be Solved

As noted above, direct thermographic materials are imaged by a recording process whereby images are generated by imagewise heating a recording material containing chemical components that provide an optical density change in an imagewise fashion. A major consideration in designing such materials is to find a combination of imaging chemicals that provide optimum image maximum density $D_{max}$ without loss of other properties. A further consideration is to find a combination of imaging chemicals that provide increased "silver efficiency" (that is, a high $D_{max}$ using only a small amount of silver).

Thus, there remains a continuing need to incorporate compounds into black-and-white direct thermographic materials to provide materials that generate a dense black metallic silver image and have high silver efficiency.

SUMMARY OF THE INVENTION

The present invention provides a black-and-white direct thermographic material comprising a support and having on at least one side thereof a thermographic imaging layer comprising, in reactive association:

a. a non-photosensitive source of reducible silver ions, b. a reducing agent for the reducible silver ions, and c. an ionic liquid in an amount of at least 10 mg/m$^2$.

This invention also provides a method comprising imaging the direct thermographic material of the invention with a thermal imaging source to provide a visible image. The resulting image can be used for medical diagnosis, among other uses.

We have found that the incorporation of certain salts, commonly known as ionic liquids, into the imaging chemistry of direct thermographic materials provides increased optical density and improved silver efficiency.

DETAILED DESCRIPTION OF THE INVENTION

The direct thermographic materials can be used to provide black-and-white images using non-photosensitive silver salts, reducing agents, ionic liquids, binders, and other components known to be useful in such materials.

The direct thermographic materials can be used in black-and-white thermography and in electronically generated black-and-white hardcopy recording. They can be used as output media, in radiographic imaging (for example digital medical imaging), X-ray radiography, and in industrial radiography. Furthermore, the absorbance of these thermographic materials between 350 and 450 nm is desirably low (less than 0.5), to permit their use in the graphic arts area (for example, in imagesetting and phototypesetting operations), in the manufacture of printing plates, in contact printing, in duplicating ("duping"), and in proofing.

The direct thermographic materials are particularly useful as output media for medical imaging of human or animal subjects in response to visible or X-radiation for diagnostic purposes. Such applications include, but are not limited to, thoracic imaging, mammography, dental imaging, orthopedic imaging, general medical radiography, therapeutic radiography, veterinary radiography, and auto-radiography.

In the direct thermographic materials, the components needed for imaging can be in one or more thermally sensitive or thermographic layers on one side ("frontside") of the support. The layer(s) that contain the non-photosensitive source of reducible silver ions, or both, are referred to herein as thermographic emulsion layer(s) or thermally sensitive imaging layer(s).

Where the materials contain thermographic imaging layers on one side of the support only, various non-imaging layers can be disposed on the "backside" (non-emulsion or non-imaging side) of the materials, such as primer layers, interlayers, opacifying layers, subbing layers, carrier layers, auxiliary layers and/or conductive layers. Particularly important non-imaging layers include a backside conductive layer and an outermost backside protective layer.

In such embodiments, various non-imaging layers can also be disposed on the "frontside," imaging, or emulsion side of the support, including primer layers, interlayers, opacifying layers, subbing layers, carrier layers, protective layers, auxiliary layers, and other layers readily apparent to one skilled in the art.

In some embodiments, the direct thermographic materials are "double-sided" and have thermographic, emulsion, or thermally sensitive imaging layer(s) on both sides of the support. In such constructions, each side can also include one or more carrier layers, primer layers, adhesive layers, interlayers, antistatic or conductive layers, auxiliary layers, and other layers readily apparent to one skilled in the art. An outermost protective layer can be on either or both sides of the support.

Definitions

As used herein:

In the descriptions of the thermographic materials, "a" or "an" component refers to "at least one" of that component (for example, the ionic liquids described below).

The term "black-and-white" refers to an image formed by silver metal.

"Thermographic material(s)" means a dry processable integral element comprising a support having at least one thermographic emulsion layer or a set of thermographic emulsion layers, (wherein the source of reducible silver ions is in one layer and other components or additives are distributed, as desired, in the same layer or in one or more additional coated layer), that provides a black-and-white silver image. Such additional layers include protective overcoat layers, carrier layers, conductive layers, and subbing or priming layers. These materials preferably have at least one outermost protective layer on the imaging side that is in direct contact with the imaging means during thermal imaging. These materials also include multilayer constructions in which one or more imaging components are in different thermographic layers, but are in "reactive association." For example, one layer can include the non-photosensitive source of reducible silver ions and another layer can include the reducing agent, but the two reactive components are in reactive association with each other. Preferably these materials have at least one outermost protective layer as described herein above all thermographic layers. By "integral," we mean that all imaging chemistry required for imaging is in the material without diffusion of imaging chemistry or reaction products (such as a dye) from or to another element (such as a receiver element).

Also, unless otherwise indicated, the terms "thermographic material" and "direct thermographic materials" are meant to refer to embodiments of the present invention.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of thermal print-heads or by thermally imaging with a modulated scanning laser beam.

The materials of this invention are direct thermographic materials that are imaged using a digital exposure and thermal imaging is carried out in a single thermographic material containing all of the necessary imaging chemistry. Direct thermal imaging is distinguishable from what is known in the art as thermal transfer imaging (such as dye transfer imaging) in which the image is produced in one material ("donor") and transferred to another material ("receiver") using thermal means.

"Catalytic proximity" or "reactive association" means that the reactive components are in the same layer or in adjacent layers so that they readily come into contact with each other during thermal imaging and development.

"Emulsion layer," "imaging layer," "thermographic layer," or "thermographic emulsion layer," means a thermally sensitive layer of a thermographic material that contains the non-photosensitive source of reducible silver ions. It can also mean a layer of the thermographic material that contains, in addition to the non-photosensitive source of reducible ions, additional desirable components. These layers are usually on what is known as the "frontside" of the support.

The frontside protective layer is the outermost layer on the imaging side of the material that is in direct contact with the imaging means. The backside protective layer is the outermost layer on side of the support opposite to that containing the imaging layer(s).

"Non-photosensitive" means not intentionally light sensitive. The direct thermographic materials described herein are non-photosensitive meaning that no photosensitive silver halide(s) has been purposely added or created.

"Simultaneous coating" or "wet-on-wet" coating means that when multiple layers are coated, subsequent layers are coated onto the initially coated layer before the initially coated layer is dry.

The sensitometric terms, absorbance, contrast, $D_{min}$, and $D_{max}$ have conventional definitions known in the imaging arts. In thermographic materials, $D_{min}$ is considered herein as image density in the areas with the minimum application of heat by the thermal print-head. The term $D_{max}$ is the maximum image density achieved when the thermographic material is thermally imaged with a given amount of thermal energy. The sensitometric term absorbance is another term for optical density (OD).

Silver Efficiency is defined as $D_{max}$ divided by the silver coating weight. It is a measure of the amount of silver that has developed under a given set of exposure and development conditions.

"Transparent" means capable of transmitting visible light or imaging radiation without appreciable scattering or absorption.

The phrases "silver salt" and "organic silver salt" refer to an organic molecule having a bond with a silver atom. Although the compounds so formed are technically silver coordination complexes or silver compounds they are also often referred to as silver salts.

The terms "double-sided," "double-faced coating," and "duplitized" are used to define thermographic materials having one or more of the same or different thermographic disposed on both sides (frontside and backside) of the support.

Ionic liquids are purely ionic salt-like materials that are liquid at unusually low temperatures. "Currently, the "official" definition of ionic liquids uses the boiling point of water as a point of reference: Ionic Liquids are ionic compounds which are liquid below 100° C." (*ChemFiles—Enabling Technologies, Ionic Liquids,* 2005, 11(6), p. 2, Sigma-Aldrich). Many ionic liquids have melting points below 50° C. and many common ionic liquids are liquid at room temperature (for example, 25° C.). Ionic liquids are liquid over a wide temperature range, from their melting point to their decomposition temperature. More details of these compounds are provided below.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl").

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group can include ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. A skilled artisan would exclude substituents that adversely react with other active ingredients as not being inert or harmless.

*Research Disclosure* (http://www.researchdisclosure-.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

Non-Photosensitive Source of Reducible Silver Ions

The non-photosensitive source of reducible silver ions used in the direct thermographic materials can be any silver-organic compound that contains reducible silver(I) ions. Such compounds are generally silver salts of silver coordinating ligands. Preferably, it is an organic silver salt that is comparatively stable to light and forms a silver image when heated to 50° C. or higher in the presence of a reducing agent. Mixtures of the same or different types of silver salts can be used if desired.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, silver behenate is used alone or in mixtures with other silver salts.

In some embodiments, a highly crystalline silver behenate can be used as part or all of the non-photosensitive sources of reducible silver ions, as described in U.S. Pat. No. 6,096,486 (Emmers et al.) and U.S. Pat. No. 6,159,667 (Emmers et al.), both incorporated herein by reference. Moreover, the silver behenate can be used in its one or more crystallographic phases (such as a mixture of phases I, II and/or III) as described in U.S. Pat. No. 6,677,274 (Geuens et al.) that is incorporated herein by reference.

Other useful but less preferred silver salts include but are not limited to, silver salts of aromatic carboxylic acids and other carboxylic acid group-containing compounds, silver salts of aliphatic carboxylic acids containing a thioether group as described in U.S. Pat. No. 3,330,663 (Weyde et al.), silver carboxylates comprising hydrocarbon chains incorporating ether or thioether linkages, or sterically hindered substitution in the α- (on a hydrocarbon group) or ortho- (on an aromatic group) position, as described in U.S. Pat. No. 5,491,059 (Whitcomb), silver salts of aliphatic, aromatic, or heterocyclic dicarboxylic acids, silver salts of sulfonates as described in U.S. Pat. No. 4,504,575 (Lee), silver salts of sulfosuccinates as described in EP 0 227 141 A1 (Leenders et al.), silver salts of acetylenes as described in U.S. Pat. No. 4,761,361 (Ozaki et al.) and U.S. Pat. No. 4,775,613 (Hirai et al.,), silver salts of compounds containing mercapto or thione groups and derivatives thereof (such as those having a heterocyclic nucleus containing 5 or 6 atoms in the ring, at least one of which is a nitrogen atom), as described in U.S. Pat. No. 3,785,830 (Sullivan et al.,) and U.S. Pat. No. 4,123,274 (Knight et al.), silver salts of mercapto or thione substituted compounds that do not contain a heterocyclic nucleus, silver salts of compounds containing an imino group (such as silver salts of benzotriazole and substituted derivatives thereof), silver salts of 1,2,4-triazoles or 1-H-tetrazoles as described in U.S. Pat. No. 4,220,709 (deMauriac), and silver salts of imidazoles and substituted derivatives thereof as described in U.S. Pat. No. 4,260,677 (Winslow et al.).

It is also convenient to use silver half soaps that are blends of silver carboxylates and carboxylic acids.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

Non-photosensitive sources of reducible silver ions can also be provided as core-shell silver salts such as those described in U.S. Pat. No. 6,355,408 (Whitcomb et al.), or as silver dimer compounds that comprise two different silver salts as described in U.S. Pat. No. 6,472,131 (Whitcomb), both of which are incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.) that is incorporated herein by reference.

The one or more non-photosensitive sources of reducible silver ions are preferably present in an amount of from about 5% to about 70% (more preferably, from about 10% to about 50%), based on the total dry weight of the emulsion layers. Stated another way, the amount of the sources of reducible silver ions is generally present in an amount of from about 0.001 to about 0.2 mol/$m^2$ of the thermographic material, and preferably from about 0.005 to about 0.05 mol/$m^2$ of that material.

Reducing Agents

The reducing agent (or reducing agent composition comprising two or more components) for reducing the reducible silver ions can be any material (preferably an organic material) that can reduce silver (1+) ion to metallic silver. For example, useful reducing agents are organic compounds containing at least one active hydrogen atom linked to an oxygen, nitrogen, or carbon atom. These reducing agents may also be known in the art as "black-and-white" developers or developing agents. Mixtures of reducing agents can be used if desired.

Conventional photographic developers can be used as reducing agents for thermographic materials, including aromatic mono-, di- and tri-hydroxy compounds such as dihydroxybenzenes (including 2,3- and 3,4-dihydroxy-benzenes) such as those described in EP 1 270 255A1 (noted above), trihydroxy-benzene compounds, alkoxynaphthols, pyrazolidin-3-one type reducing agents, pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), and other materials readily apparent to one skilled in the art.

When used with a silver carboxylate silver source in a thermo-graphic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters, (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, 3,4-dihydroxy-benzonitrile, and phenyl-(3,4-dihydroxyphenyl)ketone. Such compounds are described, for example, in U.S. Pat. No. 5,582,953 (Uyttendaele et al.) that is incorporated herein by reference.

Mixtures of catechol reducing agents with various substituents can be used to optimize reactivity, $D_{max}$, $D_{min}$, and other imaging properties of the thermographic material.

Still another particularly useful class of reducing agents are the polyhydroxy spiro-bis-indane compounds that are described in U.S. Pat. No. 3,440,049 (Moede) and U.S. Pat. No. 5,817,598 (Defieuw et al.), both incorporated herein by reference.

In some constructions, "hindered phenol reducing agents" can be used. "Hindered phenol reducing agents" are compounds that contain only one hydroxy group on a given phenyl ring and have at least one additional substituent located ortho to the hydroxy group.

One type of hindered phenol includes hindered phenols and hindered naphthols.

Another type of hindered phenol reducing agents are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)-methanes bis(hydroxyphenyl)ethers, bis(hydroxyphenyl)sulfones, and bis (hydroxyphenyl)thioethers, each of which may have additional substituents.

Preferred hindered phenol reducing agents are bis(hydroxyphenyl)-methanes such as, bis(2-hydroxy-3-t-butyl-5-methylphenyl)methane (CAO-5), 1,1'-bis(2-hydroxy-3,5-dimethylphenyl)-3,5,5-trimethylhexane (NONOX® or PERMANAX® WSO), and 1,1'-bis(2-hydroxy-3,5-dimethylphenyl)isobutane (LOWINOX® 22IB46). Mixtures of hindered phenol reducing agents can be used if desired.

Further reducing agents include certain ortho-amino-phenol, para-amino-phenol, and hydroquinone (that is, para-hydroxy-phenol) compounds described in copending and commonly assigned U.S. Ser. No. 11/012,788 (filed Dec. 15, 2004 by Whitcomb, Olson, Cowdery-Corvan, Sakizadeh, and Ishida) that is incorporated herein by reference.

Mixtures of hindered phenol reducing agents can be used if desired, such as the mixture of a hindered phenol and a hindered bis-phenol described in U.S. Pat. No. 6,413,712 (Yoshioka et al.).

The reducing agent (or mixture thereof) described herein is generally present in an amount greater than 0.1 mole per mole of silver and at 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Stated another way, the reducing agents described herein can be present in an amount of at least 0.03 mol/mol of total silver. Preferably, they are present in an amount of from about 0.05 to about 2 mol/mol of total silver. The total amount of silver in the thermographic materials is at least 3 $mmol/m^2$ and preferably from about 6 to about 12 $mmol/m^2$.

Ionic liquids

An ionic liquid has a molecular structure comprising a cation ionically associated with an anion. Preferably, ionic liquids are non-polymeric salts is a liquid below 100° C. or less, have low vapor pressure at about 25° C., and may often exist in the liquid phase over a 300-Celsius degree range. They also have a wide range of miscibilities with organic solvents, good solvation properties, and substantial conductivity. A discussion of ionic liquids can be found in *Designer Solvents*, M. Freemantle, *Chemical and Engineering News* (Mar. 30, 1998), the disclosure of which is hereby incorporated herein by reference in its entirety. This reference discloses ionic liquids consisting of salts that are liquid at ambient temperatures and that can act as solvents for a broad spectrum of chemical processes and which in some cases can serve as both catalyst and solvent. Other relevant references relating to ionic liquids that are incorporated by reference in their entirety include J. D. Holbrey, K. R. Seddon, *Clean Products and Processes* 1999, 1, 223–236, J. Dupont, C. S. Consorti, J. Spencer, J. *J Braz. Cheni. Soc.* 2000, 11, 337–344, L. C. Branco, J. N. Rosa, J. J. M. Ramos and C. A, M. Alfonso, *Chemistry A European Journal* 2002, 8, 3671–3677, and *ChemFiles—Enabling Technologies, Ionic Liquids,* 2005, 11(6), Sigma-Aldrich.

In ionic liquids, the ions are poorly coordinated, which results in these compounds being liquid below 100° C., often below 50° C., and even at room temperature. At least one ion has a delocalized charge and one component is organic (usually the cation). This prevents the formation of a stable crystal lattice. The organic cations, which are relatively large in ionic liquids compared to simple organic or inorganic cations, may account for their low melting point.

Any suitable thermographically acceptable anion can be employed. Preferred anions often have a delocalized charge character, such as tetrafluoroborate ($BF_4^-$), nitrate ($NO_3^-$), hexafluorophosphate ($PF_6^-$), perchlorate ($ClO_4^-$), phosphate ($PO_4^-$), and benzoate. Ionic liquids can also include other anions, such as chloride, bromide, iodide, and acetate.

Structurally, the ionic liquids useful in the present invention comprise a cation that is ionically associated with an anion. Either cation or anion can be organic or inorganic in nature. Preferably, the cation is an organic cation. A preferred group of ionic liquids includes imidazolium, pyrazolium, pyridinium, pyrimidinium, pyrazinium, tetra-alkylammonium, or tetra-alkylphosphonium cations. Mixtures of one or more of these types of compounds can also be used if desired. The imidazolium, pyridinium, and tetra-alkylammonium compounds are particularly preferred.

A useful class of ionic liquids includes imidazolium cations such as the compounds represented by the following Structure I:

(I)

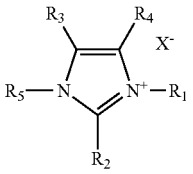

wherein $R_1$ and $R_5$ are independently substituted or unsubstituted alkyl or substituted or unsubstituted alkenyl groups, independently branched or linear and independently having from 1 to 22 carbon atoms, and $R_2$, $R_3$, and $R_4$ are independently hydrogen or substituted or unsubstituted alkyl groups, independently branched or linear, and independently having 1 to 6 carbon atoms and preferably 1 to 4 carbon atoms. Preferably, $R_1$ is a substituted or unsubstituted alkyl group having 1 to 5 carbon atoms, $R_5$ is a substituted or unsubstituted alkyl or alkenyl group having 1 to 18 carbon atoms, and $R_2$, $R_3$, and $R_4$ are independently hydrogen or a substituted or unsubstituted alkyl group having 1 to 3 carbon atoms. Most preferably, $R_1$ is an unsubstituted methyl or ethyl group.

$X^-$ is an anion such as halide (for example, chloride, bromide, or iodide), tetrafluoroborate, nitrate, hexafluorophosphate, perchlorate, phosphate, acetate, bis(trimethylsilyl)amide, dioctylsuccinate, and trifluoromethanesulfonate. Preferred anions are tetrafluoroborate, and hexafluorophosphate.

Useful ionic liquids include pyrazolium cations such as the compounds represented by the following Structure (II):

(II)

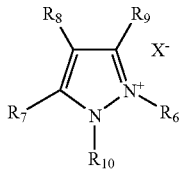

wherein $R_6$ and $R_{10}$ are independently substituted or unsubstituted alkyl groups, independently branched or linear, and independently having 1 to 22 carbon atoms, $R_7$, $R_8$, and $R_9$ are independently hydrogen or substituted or unsubstituted alkyl groups, independently branched or linear, and independently having 1 to 6 carbon atoms. Preferably, $R_6$ is a substituted or unsubstituted alkyl group having 1 to 6 carbon atoms and $R_{10}$ is a substituted or unsubstituted alkyl group having 1 to 3 carbon atoms. Preferably, $R_7$, $R_8$, and $R_9$ are independently hydrogen or a substituted or unsubstituted alkyl group having 1 to 3 carbon atoms. $X^-$ is an anion as described above for Structure I.

Useful ionic liquids also include pyridinium cations such as compounds represented by the following Structure (III):

(III)

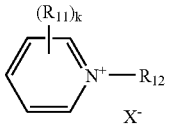

wherein $R_{12}$ is a substituted or unsubstituted alkyl group, branched or linear, having 1 to 22 carbon atoms. Preferably, $R_{12}$ has 1 to 6 carbon atoms. More preferably, $R_{12}$ has 1 to 4 carbon atoms. Each $R_{11}$ is independently hydrogen or a substituted or unsubstituted alkyl group having 1 to 6 carbon atoms and preferably 1 to 3 carbon atoms. Preferably, at least one $R_{11}$ group is hydrogen. $X^-$ is an anion as described for Structure I above and k is 0 or an integer of 1 to 4. Preferably k is 0, 1, or 2.

Another class of useful ionic liquids includes pyrimidinium and pyrazinium cations such as the compounds represented by the following Structures (IV) and (V):

(IV)

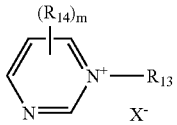

(V)

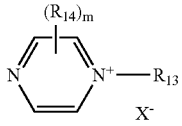

wherein $R_{13}$ is a substituted or unsubstituted alkyl group, branched or linear, having 1 to 22 carbon atoms, preferably from 1 to 6 carbon atoms and more preferably from 1 to 4 carbon atoms. Each $R_{14}$ is independently hydrogen or a substituted or unsubstituted alkyl group having 1 to 6 carbon atoms, and preferably having from 1 to 3 carbon atoms. $X^-$ is an anion as described above for Structure (I), and m is 0 or an integer of 1 to 4. Preferably m is 0, 1, or 2.

Still again, useful ionic liquids include tetra-alkylammonium and tetra-alkylphosphonium cations such as the compounds represented by the following Structures (VI) and (VII):

(VI)

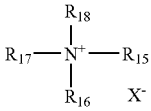

-continued (VII)

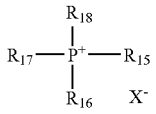

wherein $R_{15}$, $R_{16}$, $R_{17}$, and $R_{18}$ are independently substituted or unsubstituted alkyl groups, branched or linear, having 1 to 18 carbon atoms, and $X^-$ is an anion as described above for Structure (I). Preferably, one of $R_{15}$, $R_{16}$, $R_{17}$, and $R_{18}$ has 4 to 16 carbon atoms and the other groups independently have 1 to 6 carbon atoms, and more preferably, the other groups are the same groups having 1 to 4 carbon atoms.

Representative ionic liquids include the following Compounds (1) through (22) with Compounds (7), (11), and (14) being most preferred:

(1)

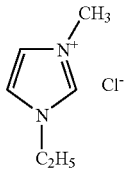

1-ethyl-3-methylimidazolium chloride - m.p. = 80° C.

(2)

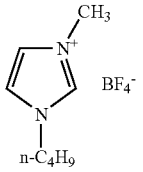

1-n-butyl-3-methylimidazolium tetrafluoroborate - m.p. = -71° C.

(3)

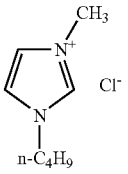

1-n-butyl-3-methylimidazolium chloride - m.p. = 41° C.

(4)

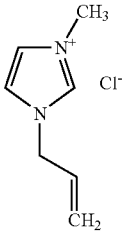

1-allyl-3-methylimidazolium chloride - m.p. = 55° C.

-continued (5)

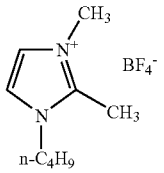

1-n-butyl-2,3-dimethylimidazolium tetrafluoroborate - m.p. = 38° C.

(6)

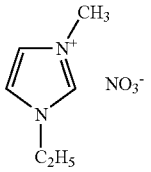

1-ethyl-3-methylimidazolium nitrate - m.p. = 38° C.

(7)

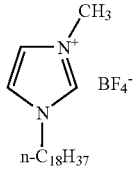

1-n-octadecyl-3-methylimidazolium tetrafluoroborate - m.p. = 64–67° C.

(8)

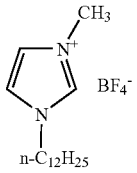

1-n-dodecyl-3-methylimidazolium tetrafluoroborate - m.p. = 26° C.

(9)

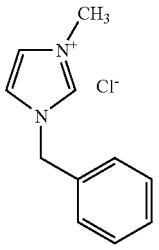

1-benzyl-3-methylimidazolium chloride - m.p. = 70° C.

(10)

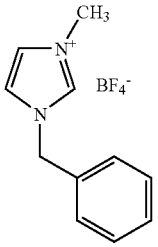

1-benzyl-3-methylimidazolium tetrafluoroborate - m.p. = 77° C.

-continued (11)

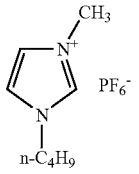

1-n-butyl-3-methylimidazolium hexafluorophosphate - m.p. = 11° C.

(12)

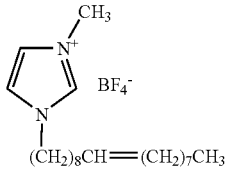

1-oleyl-3-methylimidazolium tetrafluoroborate - m.p. = 15° C.

(13)

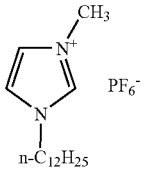

1-n-dodecyl-3-methylimidazolium hexafluorophosphate - m.p. = 60° C.

(14)

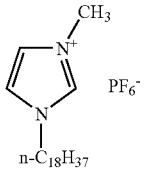

1-n-octadecyl-3-methylimidazolium hexafluorophosphate - m.p. = 80° C.

(15)

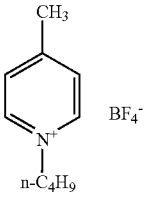

1-n-butyl-4-methylpyridinium tetrafluoroborate - m.p. = < 30° C.

(16)

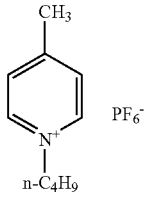

1-n-octadecyl-3-methylimidazolium iodide - m.p. = 41° C.

-continued (17)

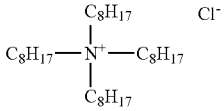

tetra-n-octylammonium chloride - m.p. = 50–54° C.

(18)

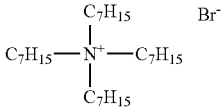

tetra-n-heptylammonium bromide - m.p. = 89–91° C.

(19)

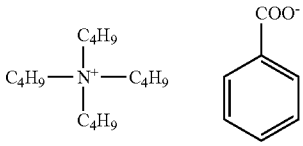

tetra-n-butylammonium benzoate m.p. = 64–67° C.

(20)

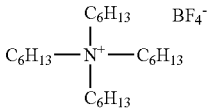

tetra-n-hexylammonium tetrafluoroborate - m.p. = 90–92° C.

(21)

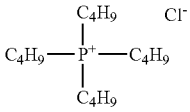

tetra-n-butylphosphonium chloride - m.p. = 62–66° C.

(22)

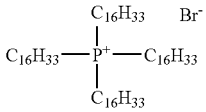

tetra-n-hexadecylphosphonium bromide - m.p. = 57–62° C.

As will be appreciated by the skilled artisan, the present invention is not limited to the particular ionic liquids mentioned above and other structures or derivatives can be used. For example, U.S. Pat. No. 5,827,602 (Koch et al.), the disclosure of which is hereby incorporated by reference in its entirety, discloses ionic liquids that are hydrophobic in nature, being poorly soluble in water, and contain only non-Lewis acid anions that may be fluorinated. Such variations in the structure of ionic liquids are encompassed by the present invention.

Certain ionic liquids may be purchased from commercial suppliers, for example Solvent Innovation GmbH (Cologne, Germany), Merck KgaA (Darmstadt, Germany), Sigma-Aldrich Chemical Company (Milwaukee, Wis.), BASF AG (Ludwigshafen, Germany), and SACHEM (Austin, Tex.).

Ionic liquids, as described above, can be also prepared by any suitable method. For example, 1-butyl-3-methylimidazolium fluoroborate can be easily prepared in two steps. The first step is boiling commercially available 1-methylimidazole with 1-chlorobutane, followed by cooling, to obtain 1-butyl-3-methylimidazolium chloride. The second step is dissolving 1-butyl-3-methyl-imidazolium chloride in water and passing the solution through an ion exchange column containing a fluoroborate salt, such as sodium fluoroborate, to obtain the desired product in water. The water can later be removed by evaporation if desired. Similar preparation methods can be employed to form other ionic liquid compounds.

One preferred method for preparing ionic liquids that have low solubility in water is described by J. D. Holbrey and K. R. Seddon, *J. Chem. Soc. Dalton Trans.* 1999, 2133. The first step is to prepare a 1-alkyl-3-methyl-imidazolium bromide salt by heating 1-methylimidazole with a 1-bromoalkane, followed by cooling. The resulting salt is dissolved in a suitable water-insoluble organic solvent such as dichloromethane, and agitated in the presence of an aqueous solution of the sodium salt of the desired anion, such as tetrafluoroborate ion. If the 1-alkyl group of the 1-alkyl-3-methylimidazolium cation is longer than about 5 carbons, the cation will remain in association with the dichloromethane, while the bromide ion will tend to migrate to the aqueous solution and be replaced by the tetrafluoroborate ion to maintain charge balance. This process avoids the necessity for an ion exchange column. The dichloromethane can be removed by evaporation if desired, to yield the pure 1-alkyl-3-methylimidazolium tetrafluoroborate salt. Additional synthetic procedures are described below before the Examples.

The ionic liquids can be added to or incorporated into any of one or more layer formulations on the imaging side of the support and in any suitable form depending upon whether they are soluble or insoluble in the coating solvent(s) of that particular layer. Preferably, they are added to the same thermographic emulsion layer comprising the reducing agent and non-photo-sensitive source of reducible silver ions. However, they can also be added to outermost protective layers or underlying "carrier" layers with the expectation that at least some of the compound(s) will diffuse into the imaging layer(s). The ionic liquids are in catalytic association with the noted imaging chemicals during the imaging process.

The one or more ionic liquids are present in an amount of at least 10 $mg/m^2$ and preferably from about 30 $mg/m^2$ to about 150 $mg/m^2$.

Other Addenda

The direct thermographic materials can also contain other additives such as toners, shelf-life stabilizers, contrast enhancers, dyes or pigments, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described in U.S. Pat. No. 5,369,000 (Sakizadeh et al.), U.S. Pat. No. 5,464,737 (Sakizadeh et al.), U.S. Pat. No. 5,594,143 (Kirk et al.) and U.S. Pat. No. 5,374,514 (Kirk et al.), and U.S. Pat. No. 5,460,938 (Kirk et al.).

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles may be used as stabilizing compounds as described in U.S. Pat. No. 6,171,767 (Kong et al.).

The direct thermographic materials may also include one or more thermal solvents (or melt formers). Combinations of these compounds can also be used including a combination of succinimide and dimethylurea. Known thermal solvents are disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

"Toners" or derivatives thereof that improve the image are highly desirable components of the thermographic materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner(s) is included. Toners may be incorporated in the thermographic emulsion layer or in an adjacent non-imaging layer.

Compounds useful as toners are described in U.S. Pat. No. 3,074,809 (Owen), U.S. Pat. No. 3,080,254 (Grant, Jr.), U.S. Pat. No. 3,446,648 (Workman), U.S. Pat. No. 3,844,797 (Willems et al.), U.S. Pat. No. 3,847,612 (Winslow), U.S. Pat. No. 3,951,660 (Hagemann et al.), U.S. Pat. No. 4,082,901 (Laridon et al.), U.S. Pat. No. 4,123,282 (Winslow), and U.S. Pat. No. 5,599,647 (Defieuw et al.,) and GB 1,439,478 (AGFA).

Additional useful toners are substituted and unsubstituted mercaptotriazoles as described in U.S. Pat. No. 3,832,186 (Masuda et al.), U.S. Pat. No. 5,149,620 (Simpson et al.), U.S. Pat. No. 6,165,704 (Miyake et al.), U.S. Pat. No. 6,713,240 (Lynch et al.), and U.S. Pat. No. 6,841,343 (Lynch et al.), all of which are incorporated herein by reference.

Phthalazine and phthalazine derivatives [such as those described in U.S. Pat. No. 6,146,822 (Asanuma et al.), incorporated herein by reference], phthalazinone, and phthalazinone derivatives are particularly useful toners.

Toners particularly useful in aqueous-coated systems include the phthalazine compounds described in U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al.), all of which are incorporated herein by reference.

The thermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine-dione and its derivatives, and quinazoline-dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.) and GB 1,565,043 (Fuji Photo).

The thermographic materials may also include one or more polycarboxylic acids and/or anhydrides thereof that are in thermal working relationship with the sources of reducible silver ions in the one or more thermally sensitive imaging layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (noted above).

Binders

The non-photosensitive source of reducible silver ions, the reducing agent composition, toners, and any other imaging layer additives are generally combined with one or more binders that are generally hydrophobic or hydrophilic in nature. Thus, either aqueous or organic solvent-based formulations can be used to prepare the thermographic materials. Mixtures of either or both types of binders can also be used.

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, Mich.), BUTVAR® (Solutia, Inc., St. Louis, Mo.), and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure*, item 38957, noted above). Cationic starches can also be used as a peptizer for tabular silver halide grains as described in U.S. Pat. No. 5,620,840 (Maskasky) and U.S. Pat. No. 5,667,955 (Maskasky).

Water-dispersible hydrophobic polymers that are provided as polymer latexes can also be used as binders in minor amounts in the thermo-graphic materials of this invention. Such materials are well known in the art including U.S. Pat. No. 6,096,486 (noted above).

Hardeners for various binders may be present if desired. Useful hardeners are well known and include diisocyanate compounds as described in EP 0 600 586 B1 (Philip, Jr. et al.) and U.S. Pat. No. 6,313,065 (Horsten et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the thermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–8.

Where the proportions and activities of the thermographic materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer.

It is particularly useful in the direct thermographic materials to use predominantly (more than 50% by weight of total binder weight) hydrophobic binders in both imaging and non-imaging layers on both sides of the support. In particular, the outermost layers are generally formulated and disposed on the support with one or more hydrophobic binders such as cellulose ester polymer binders. Of these binders, cellulose nitrate, cellulose acetate, cellulose acetate butyrate, and cellulose acetate propionate are preferred.

Support Materials

The direct thermographic materials comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Preferred supports are composed of polyesters or polycarbonates, such as polyethylene terephthalate film.

Opaque supports can also be used, such as dyed polymeric films and resin-coated papers that are stable to high temperatures. Support materials can contain various colorants, pigments, and dyes if desired. For example, the support can contain conventional blue dyes that differ in absorbance from colorants in the various frontside or backside layers as described in U.S. Pat. No. 6,248,442 (Van Achere et al.). Support materials may be treated using conventional procedures (such as corona discharge) to improve adhesion of overlying layers, or subbing or other adhesion-promoting layers can be used.

The support thickness can be within the range of from about 2 to about 15 μm. Preferably, the support thickness is from about 4 to about 10 μm.

Protective Layer

The direct thermographic materials can have a non-thermally sensitive outermost protective layer (or "overcoat layer") on at least the imaging side of the support. Preferably, this protective layer is the outermost layer on the imaging side. A wide variety of materials are useful as binders or other components in such outermost protective layers as described in U.S. Pat. No. 5,536,696 (Horsten et al.), U.S. Pat. No. 5,817,598 (Defieuw et al.), and U.S. Pat. No. 6,313,065 (noted above). Such protective layers can include matte agents (organic or inorganic particles), "slip" agents, lubricants, pigments, "thermomeltable" particles, reinforcing agents, antistatic agents, conductive agents, coating aids, and tinting agents. It is particularly desired that the outermost protective layer have a dynamic coefficient of friction of less than 0.3 when the thermographic material is moved in contact and relative to an imaging means such as a thermal print-head. For example, the dynamic coefficient of friction can be determined using the method described in U.S. Pat. No. 5,817,598 (Defieuw et al.) that is incorporated herein by reference. This "slip" property is usually provided by incorporating one or more lubricants into the outermost protective layer. The protective layer can include mixtures of lubricants such as one or more solid lubricants and one or more liquid lubricants.

In some embodiments, the thermographic materials comprise an outermost protective layer on the imaging side that comprises two or more specific lubricants from designated classes of compounds. The protective layer provides both protective and transport (or "slip") properties. Useful protective layers and their methods of preparation are described in copending and commonly assigned U.S. Pat. No. 7,071,143 (Kenney et al.) incorporated herein by reference.

More particularly, the protective layer can comprise one or more lubricants from one or more of the following categories of compounds:

(a) solid polymers, each derived from one or more olefins and from one or more ethylenically unsaturated polymerizable carboxylic acids or esters or anhydrides thereof, (b) branched α-olefin polymers, (c) additional waxes other than compounds in categories of (a) and (b), and (d) silicone oils.

Preferably, the protective layer includes one or more silicone oils and one or more compounds from any of the categories (a), (b), and (c), and more preferably at least one silicone oil and a wax from category (a) or (c).

Category (a) includes solid polymers derived from one or more olefins and from one or more ethylenically unsaturated polymerizable carboxylic acids or ester or anhydrides thereof. Suitable polymers include those described in U.S. Pat. No. 3,590,076 (Heintzelman et al.) that is incorporated herein by reference in its entirety. The number average molecular weight of the solid polymer is generally from about 300 to about 5000. Mixtures of these solid polymers can be used.

More particularly, the solid polymer is a polyolefin derived from one or more α-olefin monomers, preferably each having 2 to 8 carbon atoms. Ethylene and/or propylene are especially preferred monomers.

Suitable ethylenically unsaturated polymerizable carboxylic acid monomers are those having from 3 to 12 carbon atoms, and preferably from 4 to 5 carbon atoms. Monomers that are dicarboxylic acids and anhydrides thereof are preferred. These include maleic acid, ethyl maleic acid, propyl maleic acid, isopropyl maleic acid, fumaric acid, methylene malonic acid, glutaconic acid, itaconic acid, methyl itaconic acid, mesaconic acid, and citraconic acid and their mixtures, as well as the corresponding esters, anhydrides, and mixtures of such acids, esters and anhydrides. Isopropyl maleic acid, esters and anhydrides therefore are especially preferred.

For example, a category (a) polymer includes maleic anhydride polyethylene, maleic acid anhydride polypropylene, iso-propylmaleate polyethylene, and iso-propylmaleate polypropylene graft copolymers.

Category (b) lubricants are branched α-olefin polymers or mixtures thereof. The branched hydrocarbon typically has a number average molecular weight (as measured by vapor pressure osmometry) of at least 300, preferably at least 400, and more preferably at least 500. It typically has a number average molecular weight of no more than 10,000, preferably no more than 5,000, and more preferably no more than 3,000, although the molecular weight can be outside of these ranges. The branched hydrocarbon typically has a melting point (for crystalline materials) or a softening point (for amorphous or semi-crystalline materials) of at least 30° C., preferably at least 35° C., and more preferably at least 50° C., and typically has a melting point or softening point of no more than 120° C., although the melting point can be outside of these ranges. The degree of branching (or average number of branches per molecule) in the branched hydrocarbon typically is from about 4 to about 5, and typically is no more than about 15 although the degree of branching can be outside of these ranges. The branched hydrocarbon can be saturated or unsaturated, and can include cyclic moieties. In addition, oxidized hydrocarbons, such as polyethylene-based oxidized materials and microcrystalline-based oxidized materials can be used, as can unsaturated and branched hydrocarbon-like molecules using as a core cyclic compounds or dendrimer or arborols.

Also suitable are homopolymers and copolymers prepared from monomers of the formula $R^dCH{=}CH_2$ wherein $R^d$ is a substituted or unsubstituted alkyl group having from 1 to 18 carbon atoms, and preferably from 3 to 12 carbon atoms, although the number of carbon atoms can be outside of these ranges. The polymerized α-olefin is also known as an olefin-derived hydrocarbon polymer or catalytically polymerized α-olefin.

These polymers can be prepared using for example, using the polymerization process described in U.S. Pat. No. 4,060,569 (Woods et al.) that is incorporated herein by reference.

Some polymerized α-olefins are commercially available for example, from the Baker Petrolite Corporation (Sugar Land, Tex.) under the tradename VYBAR®, that is available in solid (for example VYBAR® 103, VYBAR® 260) or liquid (for example VYBAR® 825) form.

Examples of suitable branched hydrocarbons include VYBAR® 253, a poly(α-olefin) having a number average molecular weight of about 520, a softening point of about 67° C. (measured by ASTM method D36) and a degree of branching of from about 5 to about 10. This polymer is based on an ethylene structure having pendant hydrocarbon side chains and is also referred to as a poly(α-olefin) or a poly(1-alkene). Also suitable for use are VYBAR® 103 having a number average molecular weight of about 4400, VYBAR® 260 having a number average molecular weight of about 2,600, and the VYBAR® X-series polymers, such as X-6044, X-6059, and X-6028. Also useful are oxidized hydrocarbons such as those available from Baker Petrolite Corp. as polyethylene-based oxidized materials and microcrystalline-based oxidized materials, such as the CARDIS® and PETRONAUBA® materials.

A particularly useful branched polyolefin is VYBAR® 103, CAS [68527-08-2] that is described as alkenes, macromonomers with greater than 10 carbon atoms that are α-polymerized and having a softening point of 74° C. (165.2° F.).

The third category (c) compounds include any suitable wax that will form a hydrophobic coating. Thus, animal, vegetable, mineral and synthetic waxes may be employed, as may be mixtures thereof.

Generally speaking, a wax is a substance that is a solid at ambient temperature and that has a low viscosity at just above its melting point. Typically, a wax is a substance having the following properties: (1) crystalline to microcrystalline structure, (2) capacity to acquire gloss when rubbed (as distinct from greases), (3) capacity to produce pastes or gels with suitable solvents or when mixed with other waxes, (4) low viscosity at just above the melting point. See *Grant & Hackh's Chemical Dictionary* (5th Edition), page 628, hereby incorporated by reference. Waxes differ from fats in that fats are esters of trihydric lower alcohols.

The following components are illustrative types of both synthetically prepared and naturally occurring waxes:

Useful mineral waxes include but are not limited to paraffin (26–30 carbon atom aliphatic hydrocarbons), microcrystalline waxes (41–50 carbon atom branched chain hydrocarbons), oxidized microcrystalline waxes (hydrocarbons, esters, fatty acids), montan (waxing acids, alcohols, ester, and ketones), Hoechst waxes (oxidized montan wax), and ozokerite waxes (high molecular weight aliphatic and alkenyl hydrocarbons).

Useful vegetable waxes include but are not limited to, carnauba wax (complex alcohols and hydrocarbons), esparto, flax, and sugarcane waxes (fatty acid esters, aldehydes, esters, alcohols, hydrocarbons), and candelilla waxes (hydrocarbons, acids, esters, alcohols, and lactones).

Useful animal waxes include but are not limited to beeswax.

Useful synthetic waxes include but are not limited to polyolefins derived from one or more olefins.

One preferred additional wax is the fully saturated homopolymer of a low molecular weight polyethylene (such as a low molecular weight polyolefin), or copolymers of various alkene monomers that form polymers with a molecular weight at or below 3,000, a melting point below 130° C., and low melt viscosities. Applicable waxes could include POLYWAX® that is available from Baker Petrolite Corp. Another preferred wax is carnuba wax available as a dispersion from Elementis Specialties (Hightstown, N.J.) under the name Slip-Ayd® SL 508.

In preferred embodiments, component (c) is a microcrystalline wax, carnauba wax, petronauba wax, paraffin wax, candelilla wax, or a linear low molecular weight polyethylene.

POLYWAX® is a linear polyethylene wax. A particularly preferred wax is POLYWAX® 400, CAS [9002-88-4], described as polyethylene homopolymer with weight average molecular weight of about 450 and a melting point of 81° C. (177.8° F.). Additional information on this material can be found at the website for POLYWAX® 400:

<http/www.bakerhughes.com/bakerpetrolite/polymers/ethylene_homopolymers.htm>.

Silicone oils useful in category (d) include poly(diphenylphenylmethylsiloxane), poly(diphenylsiloxane), poly(methylethylsiloaxane), poly(methylbutylsiloxane), poly(methylhexylsiloxane), and polydimethylsiloxane. Silicone oils can also possess a variety of terminating groups, including trimethylsilyl, distearate, perfluorooctadecyl, and aminopropyl. Particularly preferred silicone oils are aminopropyl terminated poly(dimethylsiloxane)s that are available from Gelest, Inc (Morrisville, Pa.).

The total amount of lubricants in the protective layer is generally of from about 0.01 to about 1.5 g/m$^2$ and preferably from about 0.08 to about 0.3 g/m$^2$.

One or more binders may also be used in the protective layer. In preferred embodiments, polymeric thermoplastic binders are employed. Examples of such materials include but are not limited to, poly(styrene-co-acrylonitrile) (for example a 70/30 monomer weight ratio), poly(vinyl alcohol-co-butyral) (available commercially as BUTVAR® B-79 or S-LEC BL5Z or MOWITAL® SB45H), poly(vinyl alcohol-co-acetal), poly(vinyl alcohol-co-benzal), polystyrene, poly (vinyl acetate), cellulose acetate butyrate (available commercially as CAB 171-15S), cellulose acetate propionate, cellulose acetate, ethyl cellulose, cellulose triacetate, poly (methyl methacrylate), and copolymers derived from methyl methacrylate. In preferred embodiments of the invention, the binder is CAB 171-15.

The amount of the binder(s) present in the protective layer is generally in an amount of from about 50 to about 95 weight % of the total protective layer.

The protective layer can also contain matting agents such as particles of starch, titanium dioxide, zinc oxide, silica, and calcium carbonate, and polymeric beads including beads of the type described in U.S. Pat. No. 2,992,101 (Jelley et al.) and U.S. Pat. No. 2,701,245 (Lynn). The matting agents can be composed of any useful material and may have an average size in relation to the protective layer thickness that enables at least some of them to protrude through the outer surface of the protective layer, as described for example, in U.S. Pat. No. 5,536,696 (noted above). If matting agents are present, they generally comprise from about 0.2 to about 10 dry weight % of the protective layer. It may be desirable that the outermost protective layer that is in contact with thermal imaging means has a dynamic coefficient of friction less than 0.3 as described in U.S. Pat. No. 5,817,598 (noted above), incorporated herein by reference for the measurement of coefficient of friction. This may be accomplished with an appropriate use of lubricants and matting agents as one skilled in the art would readily understand.

Polymeric fluorinated surfactants may also be useful in the protective layer as described in U.S. Pat. No. 5,468,603 (Kub).

In addition, nanometer size particles can be used as reinforcing agents in the protective layer. Such particles are described in for example, in U.S. Patent Application Publication 2004/0198602 (Pham) that is incorporated herein by reference.

In general, the outermost protective layer has a dry thickness of from about 0.1 to about 10 mμ. Preferably the protective layer dry thickness is from about 1 to about 6 mμ, and more preferably, it is from about 2 to about 4 mμ.

Thermographic Formulations and Constructions

An organic-based formulation for the thermographic emulsion layer(s) can be prepared by dissolving and dispersing the binder, the source of non-photosensitive silver ions, the reducing agent, and optional addenda in an organic solvent, such as toluene, 2-butanone (methyl ethyl ketone), acetone, or tetrahydrofuran (or mixtures thereof).

Alternatively, the desired imaging components can be formulated with a hydrophilic binder (such as gelatin, a gelatin-derivative, or a latex) in water or water-organic solvent mixtures to provide aqueous-based coating formulations.

The direct thermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.,) and U.S. Pat. No. 2,701,245 (Lynn). Polymeric fluorinated surfactants may also be useful in one or more layers as described in U.S. Pat. No. 5,468,603 (noted above).

The direct thermographic materials can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), polythiophenes as described in U.S. Pat. No. 5,747,412 (Leenders et al.), electro-conductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles used in a buried backside conductive layer as described in U.S. Pat. No. 6,689,546 (LaBelle et al.), U.S. Pat. No. 7,067,242 (Ludemann et al.), U.S. Pat. No. 7,022,467 (Ludemann et al.), and U.S. Pat. No. 7,018,787 (Ludemann et al.), and in U.S. Patent Application Publications 2006/0046215 (Ludemann et al.) and 2006/0046932 (Ludemann et al.). All of the above patents and patent applications are incorporated herein by reference.

In addition to the conductive particles described above, other conductive materials may be present in either the buried conductive backside layer or other backside layers. Such compositions include fluorochemicals that are described in U.S. Pat. No. 6,699,648 (Sakizadeh et al.) and U.S. Pat. No. 6,762,013 (Sakizadeh et al.). Both of these patents are incorporated herein by reference.

The thermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.), incorporated herein by reference.

The thermographic materials can be constructed of two or more layers on the imaging side of the support. Two-layer materials would include a single thermally sensitive imaging layer and an outermost protective layer. The single thermally sensitive imaging layer would contain the non-photosensitive source of reducible silver ions, the reducing agent, the binder, as well as optional materials such as toners, coating aids, and other adjuvants.

Three-layer constructions comprising two imaging layer coatings containing the ingredients and an outermost protective are generally found on the frontside of the materials.

Layers to promote adhesion of one layer to another in thermo-graphic materials are also known, as described in U.S. Pat. No. 4,741,992 (Przezdziecki), U.S. Pat. No. 5,804,365 (Bauer et al.), and U.S. Pat. No. 5,891,610 (Bauer et al.,). Adhesion can also be promoted using specific polymeric adhesive materials as described in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,746,831 (Hunt), and in U.S. Patent Application Publication 2004/0126719 (Geuens et al.), all incorporated herein by reference.

Layer formulations described herein can be coated by various coating procedures including wire wound rod coating, dip coating, air knife coating, curtain coating, slide coating, or extrusion coating using hoppers of the type described in U.S. Pat. No. 2,681,294 (Beguin). The formulations can be coated one at a time, or two or more formulations can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical wet coating thickness for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 361/V Densitometer equipped with 301 Visual Optics.

When the layers are coated simultaneously using various coating techniques, a "carrier" layer formulation comprising a single-phase mixture of the two or more polymers described above may be used as described in U.S. Pat. No. 6,436,622 (Geisler), incorporated herein by reference.

Mottle and other surface anomalies can be reduced in the materials of this invention by incorporation of a fluorinated polymer as described in U.S. Pat. No. 5,532,121 (Yonkoski et al.) or by using particular drying techniques as described in U.S. Pat. No. 5,621,983 (Ludemann et al.).

Preferably, two or more layer formulations are applied simultaneously to a film support using slide coating techniques, a protective layer being coated on top of a thermographic layer while the thermographic layer is still wet.

While the first and second layers can be coated on one side of the film support, manufacturing methods can also include forming on the opposing or backside of said polymeric support, one or more additional layers, including an outermost protective layer.

It is preferred that the conductive layers be disposed on the backside of the support and especially where it is buried or underneath one or more other layers such as backside protective layer(s). Such backside conductive layers typically have a water electrode resistivity (WER) of about $10^5$ to about $10^{12}$ ohm/sq. This technique is described in R. A. Elder *Resistivity Measurements on Buried Conductive Layers*, EOS/ESD Symposium Proceedings, Lake Buena Vista, Fla., 1990, pp. 251–254, [EOS/ESD stands for Electrical Overstress/Electrostatic Discharge].

Preferably, the backside conductive layer comprises non-acicular metal antimonate particles composed of $ZnSb_2O_6$. Several conductive metal antimonates are commercially available from Nissan Chemical Industry, Ltd. (Japan) under the tradename CELNAX® CX-Z 401M. The metal antimonate particles in the conductive layer are predominately (more than 50% by weight of total particles) in the form of clusters of non-acicular particles as opposed to "acicular" particles. By "non-acicular" particles is meant not needle-like, that is, not acicular. Preferably the metal antimonate is of $ZnSb_2O_6$.

The conductive layer is generally coated out of one or more miscible organic solvents including, but not limited to, methyl ethyl ketone (2-butanone, MEK), acetone, toluene, tetrahydrofuran, ethyl acetate, ethanol, methanol, or any mixture of any two or more of these solvents. Alternatively, the conductive layer can be coated using aqueous solvents and a hydrophilic binder or a polymer latex.

As noted above, the conductive layer also includes one or more binder materials that are usually polymers that are generally soluble or dispersible in the organic solvents noted above. Polyvinyl acetals, polyesters, cellulosic ester polymers, and vinyl polymers such as polyvinyl acetate and polyvinyl chloride are preferred, and the polyvinyl acetals, polyesters, and cellulosic ester polymers are particularly preferred. Blends of these various polymers can also be used to advantage in the conductive layer.

Imaging/Development

The direct thermographic materials can be imaged in any suitable manner consistent with the type of material using any suitable source of thermal energy. The image may be "written" simultaneously with development at a suitable temperature using a thermal stylus, a thermal print-head, or a laser, or by heating the material as it is moved while in contact with a heat absorbing material. The thermographic materials may include a dye (such as an IR-absorbing dye) to facilitate direct development by exposure to laser radiation. The dye converts absorbed radiation to heat. Thermal development is carried out with the materials being in a substantially water-free environment and without application of any solvent to the materials.

Use as a Photomask

The direct thermographic materials are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials affords a visible image. The thermographic materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the thermographic material provides an image in the imageable material. This method is particularly useful where the imageable medium comprises a printing plate and the thermographic material serves as an imagesetting film.

The following examples are provided to illustrate the practice of the present invention and the invention is not meant to be limited thereby.

Materials and Methods for the Experiments and Examples:

All materials used in the following examples can be prepared using known synthetic procedures or are available from standard commercial sources, such as Aldrich Chemical Co. (Milwaukee, Wis.), unless otherwise specified. All percentages are by weight unless otherwise indicated. The following additional materials were prepared and used.

Many of the chemical components used herein are provided as a solution. The term "active ingredient" means the amount or the percentage of the desired material contained in a sample. All amounts listed herein are the amount of active ingredient added unless otherwise specified.

ALBACAR 5970 is a 1.9 μm precipitated calcium carbonate. It is available from Specialty Minerals, Inc. (Bethlehem, Pa.).

BUTVAR® B-79 is a polyvinyl butyral resin available from Solutia, Inc. (St. Louis, Mo.).

CAB 171-15S is a cellulose acetate butyrate resin available from Eastman Chemical Co. (Kingsport, Tenn.).

CELNAX® CX-Z401M is a 40% organosol dispersion of non-acicular zinc antimonate particles in methanol. It was obtained from Nissan Chemical America Corporation (Houston, Tex.).

MEK is methyl ethyl ketone (or 2-butanone).

PARALOID® A-21 is an acrylic copolymer available from Rohm and Haas (Philadelphia, Pa.).

PIOLOFORM® BL-16 and BS-18 are polyvinyl butyral resins available from Wacker Polymer Systems (Adrian, Mich.).

PS512 is an aminopropyldimethyl terminated polydimethylsiloxane available from United Chemical Technologies (Bristol, Pa.).

VITEL® PE7915 is a copolyester resin and is available from Bostik, (Middleton, Mass.).

Developer D-1 is 2,3-dihydroxybenzoic acid.

Densitometry Measurements:

Densitometry measurements were made on a custom built computer-scanned densitometer and meeting ISO Standards 5-2 and 5-3. They are believed to be comparable to measurements from commercially available densitometers. Density of the wedges was then measured with a computer densitometer using a filter appropriate to the sensitivity of the thermographic material to obtain graphs of density versus log exposure (that is, D log E curves).

The following examples demonstrate the use of the protective layers described for the invention as protective layers on the frontside of thermographic materials.

General Procedure for the Preparation of Tetrafluoroborate Salts:

A solution of chloride or bromide salts of various cations (for example, imidazolium, pyridinium, tetra-alkylammonium, etc.) in dichloromethane was treated vigorously in a separatory funnel with about a 10% molar excess amount of sodium tetrafluoroborate in water. The dichloromethane phase was then separated, washed with water, and dried over anhydrous magnesium sulfate. Removal of the solvent in vacuo gave the desired tetrafluoroborate salt.

General Procedure for the Preparation of Hexafluorophosphate Salts of Comparative Compounds:

Hexafluorophosphate salts of various cations were prepared as above except that potassium hexafluorophosphate was used instead of sodium tetrafluoroborate.

General Procedure for the Preparation of Iodide Salts of Comparative Compounds:

Iodide salts of various cations were prepared as above except that sodium iodide was used instead of sodium tetrafluoroborate.

EXAMPLE 1

Preparation of Primer Layer:

A solution containing 15 weight % of VITEL® 7915 in MEK was coated onto a 7 mil (178 μm) blue tinted polyethylene terephthalate support and dried in an oven at 85° C. for 4 minutes to form a priming layer prior to the coating of the image forming layer. The coating weight of the primer layer was 1 g/m$^2$.

Preparation of Thermographic Coatings:

Silver Soap Homogenate Formulation:

A silver soap thermographic homogenate formulation was prepared with the following components.

| | |
|---|---|
| MEK | 75.5 parts |
| Silver Behenate | 24.0 parts |
| PIOLOFORM ® BL-16 | 0.5 parts |

The materials were mixed and homogenized by passing twice through a homogenizer at 5000 psi (352 kg/cm$^2$). The materials were cooled between the two passes.

Thermographic Emulsion Formulation:

Three thermographic emulsion layer formulations were prepared by mixing the components shown in TABLE 1. Solution A contained no ionic liquid. It served as a control. Solutions B and C contained the indicated ionic liquids.

TABLE I

| Compound | Amount (g) Solution A | Solution B | Solution C | Mixing Time (Minutes) |
|---|---|---|---|---|
| Silver behenate homogenate (24%) in MEK | 52 | 52 | 52 | |
| | 52.16 | 42.16 | 42.16 | 15 |
| Ionic Liquid Compound (7) | 0 | 0.5 | 0 | 15 |
| Ionic Liquid Compound (14) | 0 | 0 | 0.5 | |
| in MEK | 0 | 9.5 | 9.5 | |
| Tetrachlorophthalic acid | 0.11 | 0.11 | 0.11 | 60 |
| 4-Hydroxyphthalic acid | 0.84 | 0.84 | 0.84 | |
| in Methanol | 9.05 | 9.05 | 9.05 | |
| 1(2H)-Phthalazinone | 2 | 2 | 2 | 30 |
| BUTVAR ® B-79 | 31.15 | 31.15 | 31.15 | 60 |
| Polyvinyl butyral | | | | |
| 2,3-Dihydroxybenzoic acid | 2.69 | 2.69 | 2.69 | 60 |
| Total | 150 | 150 | 150 | |

Preparation of Protective Layer Formulation:

A protective layer formulation was prepared by mixing the following materials:

| | |
|---|---|
| MEK | 62.77 parts |
| CAB 171-15S | 12.11 parts |
| PARALOID ® A-21 | 1.65 parts |
| PS512 | 0.39 parts in 2.17 parts of MEK |
| ALBACAR 5970 | 0.93 parts in 19.98 g of MEK |

Preparation of and Evaluation of Thermographic Materials:

Each of the thermographic emulsion formulations and protective layer formulation was coated onto the primed 7 mil (178 μm) blue tinted polyethylene terephthalate support prepared above. A conventional, laboratory scale, dual-knife coater was used. Samples were dried in an oven at 185° F. (85° C.) for 7 minutes. The coating weight of the thermographic emulsion layer was 1.8 g/ft$^2$ (19.4 g/m$^2$). The coating weight of the protective layer was 0.3 g/ft$^2$ (3.2 g/m$^2$).

The resulting thermographic sheets were imaged with an AGFA DryStar™ Model 2000 printer. A test pattern was used. All samples gave several levels of gray and a black image.

The sensitometric results, shown below in TABLE II, demonstrate that Ionic Liquid Compounds (7) and (14) increased $D_{max}$ and improved the silver efficiency (defined as $D_{max}$/Ag coating weight) without causing an increase in $D_{min}$.

TABLE II

| Sample | Thermographic Formulation | $D_{min}$ | $D_{max}$ | Silver Coating Weight (g/m$^2$) | Silver Efficiency |
|---|---|---|---|---|---|
| 1-1-C | A | 0.21 | 3.33 | 0.96 | 3.46 |
| 1-2-I | B | 0.21 | 3.78 | 0.96 | 3.93 |
| 1-3-I | C | 0.21 | 3.52 | 0.92 | 3.83 |

EXAMPLE 2

Thermographic Emulsion Formulation:

Three thermographic emulsion layer formulations were prepared by mixing the components shown in TABLE III. Solution A contained no ionic liquid. It served as a control. Solutions B and C contained ionic liquid compound at the levels indicated.

TABLE III

| Compound | Amount (g) Solution A | Solution B | Solution C | Mixing Time (Minutes) |
|---|---|---|---|---|
| Silver behenate | 52 | 52 | 52 | 15 |
| homogenate (24%) in MEK | 68.00 | 68.00 | 68.00 | |
| Ionic Liquid | 0 | 0.80 | 4.00 | 15 |
| Compound (11) in MEK | 0 | 0 | 0 | |
| Tetrachlorophthalic acid | 0.11 | 0.11 | 0.11 | 60 |
| 4-Hydroxyphthalic | 0.84 | 0.84 | 0.84 | |
| acid in Methanol | 0 | 0 | 0 | |
| 1(2H)-Phthalazinone | 2.4 | 2.4 | 2.4 | 30 |
| BUTVAR ® B-79 | 31.16 | 31.16 | 31.16 | 60 |
| Polyvinylbutyral | 1.47 | 1.47 | 1.47 | 60 |
| 2,3-Dihydroxybenzoic acid | | | | |
| Total | 155.98 | 156.78 | 159.98 | |

Preparation of Protective Layer Formulation:

A protective layer formulation was prepared as described in Example 1 above.

Preparation of and Evaluation of Thermographic Materials:

Each of the thermographic emulsion layer and protective layer formulations were coated onto an unprimed 7 mil (178 μm) blue tinted polyethylene terephthalate support. A conventional, laboratory scale, dual-knife coater was used. Samples were dried in an oven at 185° F. (85° C.) for 7 minutes. The coating weight of the thermographic emulsion layer was 1.8 g/ft$^2$ (19.4 g/m$^2$). The coating weight of the protective layer was 0.3 g/ft$^2$ (3.2 g/m$^2$).

The resulting thermographic sheets were imaged with an AGFA DryStar™ Model 2000 printer. A test pattern was used. All samples gave several levels of gray and a black image.

The sensitometric results, shown below in TABLE IV, demonstrate that Ionic Liquid Compound (11) increases $D_{max}$ and improves the silver efficiency (defined as $D_{max}$/Ag coating weight) without causing an increase in $D_{min}$.

TABLE IV

| Sample | Thermographic Formulation | $D_{min}$ | $D_{max}$ | Silver Coating Weight (g/m$^2$) | Silver Efficiency |
|---|---|---|---|---|---|
| 2-1-C | A | 0.247 | 3.07 | 1.04 | 2.95 |
| 2-2-I | B | 0.242 | 3.14 | 0.91 | 3.45 |
| 2-3-I | C | 0.247 | 3.20 | 0.85 | 3.76 |

The invention has been described in detail with particular reference to certain preferred embodiments thereof, but it will be understood that variations and modifications can be effected within the spirit and scope of the invention.

The invention claimed is:

1. A black-and-white direct thermographic material comprising a support and having on at least one side thereof a thermographic layer comprising, in reactive association:

a. a non-photosensitive source of reducible silver ions, b. a reducing agent for said reducible silver ions, and c. an ionic liquid in an amount of at least 10 mg/m$^2$.

2. The material of claim 1 wherein said ionic liquid comprises an imidazolium, pyrazolium, pyridinium, pyrimidinium, pyrazinium, tetra-alkylammonium, or tetra-alkylphosphonium cation.

3. The material of claim 2 wherein said ionic liquid comprises an imidazolium, pyridinium, or tetra-alkylammonium cation.

4. The material of claim 1 comprising one or more of the ionic liquids represented by one or more of the following Structures I, II, III, IV, V, VI, and VII:

(I)

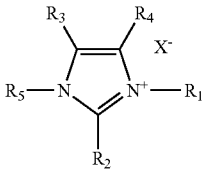

wherein $R_1$ and $R_5$ are independently alkyl or alkenyl groups, $R_2$, $R_3$, and $R_4$ are independently hydrogen or alkyl groups, and $X^-$ is an anion, (II)

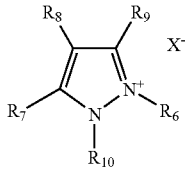

wherein $R_6$ and $R_{10}$ are independently alkyl groups, $R_7$, $R_8$, and $R_9$ are independently hydrogen or alkyl groups, and $X^-$ is an anion, (III)

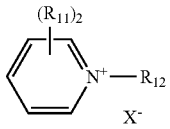

wherein $R_{12}$ is an alkyl group, each $R_{11}$ is independently hydrogen or an alkyl group, and $X^-$ is an anion, (IV)

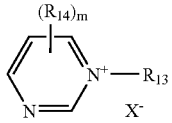

(V)

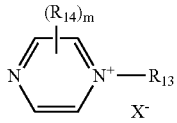

wherein $R_{13}$ is an alkyl group, each $R_{14}$ is an hydrogen or an alkyl group, $X^-$ is an anion, and m is 0 or an integer of 1 to 4, and (VI)

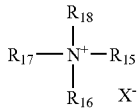

(VII)

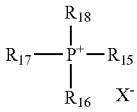

wherein $R_{15}$, $R_{16}$, $R_{17}$, and $R_{18}$ are independently alkyl groups, and $X^-$ is an anion.

5. The material of claim 1 wherein said ionic liquid is one or more of the following Compounds (1) through (22):

(1)

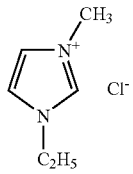

1-ethyl-3-methylimidazolium chloride

-continued (2)

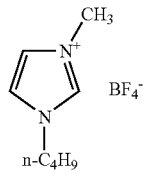

1-n-butyl-3-methylimidazolium tetrafluoroborate (3)

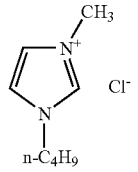

1-n-butyl-3-methylimidazolium chloride (4)

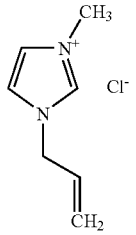

1-allyl-3-methylimidazolium chloride (5)

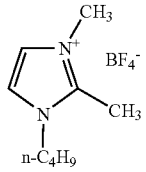

1-n-butyl-2,3-dimethylimidazolium tetrafluoroborate (6)

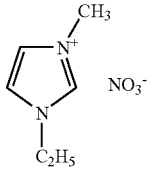

1-ethyl-3-methylimidazolium nitrate (7)

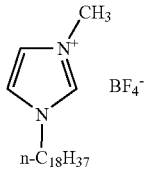

1-n-octadecyl-3-methylimidazolium tetrafluoroborate

-continued (8)

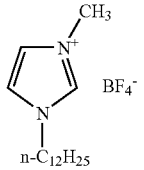

1-n-dodecyl-3-methylimidazolium tetrafluoroborate (9)

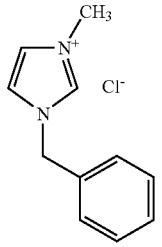

1-benzyl-3-methylimidazolium chloride (10)

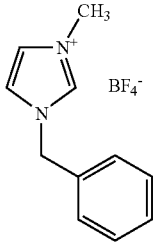

1-benzyl-3-methylimidazolium tetrafluoroborate (11)

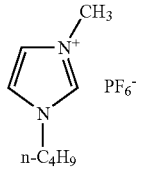

1-n-butyl-3-methylimidazolium hexafluorophosphate (12)

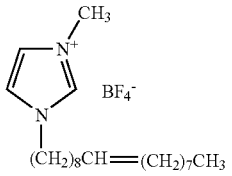

1-oleyl-3-methylimidazolium tetrafluoroborate (13)

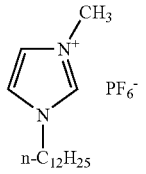

1-n-dodecyl-3-methylimidazolium hexafluorophosphate

-continued (14)

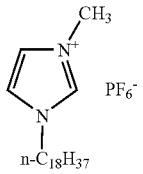

1-n-octadecyl-3-methylimidazolium hexafluorophosphate (15)

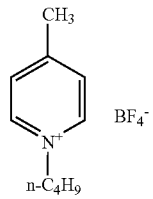

1-n-butyl-4-methylpyridinium tetrafluoroborate (16)

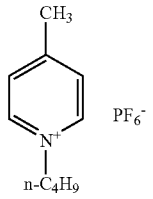

1-n-octadecyl-3-methylimidazolium iodide (17)

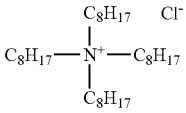

tetra-n-octylammonium chloride (18)

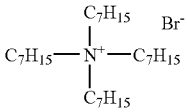

tetra-n-heptylammonium bromide (19)

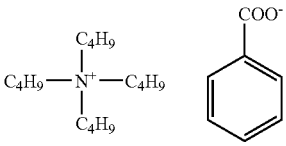

tetra-n-butylammonium benzoate (20)

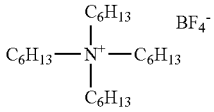

tetra-n-hexylammonium tetrafluoroborate (21)

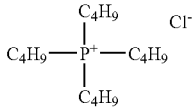

tetra-n-butylphosphonium chloride

-continued (22)

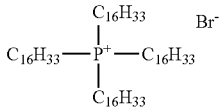

tetra-n-hexadecylphosphonium bromide

6. The material of claim 1 wherein said ionic liquid is present in an amount of from about 30 to about 150 mg/m$^2$.

7. The material of claim 1 wherein said non-photosensitive source of reducible silver ions, said reducing agent, and said ionic liquid are present in the same thermographic layer.

8. The material of claim 1 comprising one or more thermographic layers on both sides of said support.

9. The material of claim 1 wherein said reducing agent comprises one or more of a benzene compound in which the benzene nucleus is substituted by no more than two hydroxy groups which are present in 2,3-position on the benzene nucleus and have in the 1-position of the benzene nucleus a substituent linked to the nucleus by means of a carbonyl group, or in which the benzene nucleus is substituted by no more than two hydroxy groups which are present in 3,4-position on the benzene nucleus and have in the 1-position of the benzene nucleus a substituent linked to the nucleus by means of a carbonyl group.

10. The material of claim 1 wherein said non-photosensitive source of reducible silver ions includes one or more silver carboxylates, one of which is highly crystalline silver behenate.

11. The material of claim 1 wherein said ionic liquid is a liquid below 100° C.

12. The material of claim 1 further comprising a non-thermally sensitive protective layer disposed on said imaging layer.

13. The material of claim 12 wherein said protective layer is the outermost layer of said material and comprises matte particles and one or more lubricants.

14. The material of claim 1 further comprising a conductive layer on the backside of said support.

15. The material of claim 14 wherein said conductive layer comprises non-acicular metal antimonate particles composed of $ZnSb_2O_6$.

16. The material of claim 1 further comprising a thermal solvent, or phthalazinone as a toner.

17. A method comprising imaging the direct thermographic material of claim 1 with a thermal imaging source to provide a visible image.

18. The method of claim 17 wherein said imaging is carried out using a thermal print-head when said thermographic material is moved in contact with and relative to said thermal print-head.

19. The method of claim 17 wherein said visible image is used for medical diagnostic purposes.

20. The method of claim 17 wherein said direct thermographic material has an outermost protective layer that has a dynamic coefficient of friction of less than 0.3 when moved in contact with said thermal imaging source.

* * * * *